US006932218B2

(12) United States Patent
Kosann et al.

(10) Patent No.: US 6,932,218 B2
(45) Date of Patent: Aug. 23, 2005

(54) FOLDING PHOTO CASE

(75) Inventors: Rod G. Kosann, New Canaan, CT (US); Monica Kosann, New Canaan, CT (US)

(73) Assignee: Monica Rich Kosann Photography LLC, New Canaan, CT (US)

( * ) Notice: Subject to any disclaimer, the term of this patent is extended or adjusted under 35 U.S.C. 154(b) by 177 days.

(21) Appl. No.: 10/190,038

(22) Filed: Jul. 3, 2002

(65) Prior Publication Data

US 2004/0004015 A1 Jan. 8, 2004

(51) Int. Cl.[7] ..... B65D 85/48
(52) U.S. Cl. ..... 206/449; 40/530; 40/733
(58) Field of Search ..... 206/449, 451, 206/455, 456, 37, 37.4, 39, 39.1, 38, 581; 220/845, 848, 826, 827, 829, 830, 529, 521, 522, 524; 150/147, 148, 149; 40/700, 722, 723, 724, 530, 733, 766, 779

(56) References Cited

U.S. PATENT DOCUMENTS

| | | | | | |
|---|---|---|---|---|---|
| 387,779 | A | | 8/1888 | Erschell | |
| 823,213 | A | * | 6/1906 | Gibson | 206/216 |
| 957,539 | A | | 5/1910 | Berkebile | |
| 1,010,949 | A | * | 12/1911 | Polverino | 16/365 |
| 1,214,477 | A | * | 1/1917 | McCormack | 40/779 |
| 1,358,540 | A | * | 11/1920 | Goodwin | 206/37 |
| 1,666,652 | A | * | 4/1928 | Hiering | 220/324 |
| 1,889,789 | A | * | 12/1932 | Perez | 206/92 |
| 2,087,056 | A | * | 7/1937 | Bowen | 206/86 |
| 2,231,909 | A | * | 2/1941 | Hempel | 16/296 |
| 3,062,364 | A | * | 11/1962 | Ziemski | 220/4.24 |
| 3,079,771 | A | * | 3/1963 | Donle | 63/19 |
| 3,224,480 | A | * | 12/1965 | Burman, Jr. | 206/37.7 |
| 4,421,127 | A | * | 12/1983 | Geer | 132/294 |
| 4,521,035 | A | * | 6/1985 | Berezowsky | 281/48 |
| 4,601,489 | A | * | 7/1986 | Stancato | 281/21.1 |
| 4,750,282 | A | | 6/1988 | Zennedjian | |
| 4,980,983 | A | | 1/1991 | Champley | |
| 5,282,537 | A | * | 2/1994 | Wong | 206/485 |
| 5,560,476 | A | * | 10/1996 | Lee | 206/38 |
| 5,659,990 | A | | 8/1997 | Henneman et al. | |
| 5,894,931 | A | | 4/1999 | Dunn | |
| 5,996,815 | A | | 12/1999 | Walters et al. | |
| 6,233,859 | B1 | | 5/2001 | Kilpatrick et al. | |
| 6,349,494 | B1 | | 2/2002 | Haggarty-Robbins | |
| 6,513,672 | B1 | * | 2/2003 | Ovadia | 220/495.01 |

* cited by examiner

*Primary Examiner*—Shian T. Luong
(74) *Attorney, Agent, or Firm*—Gordon & Jacobson, PC

(57) ABSTRACT

A folding photo case includes a pair of exterior case members coupled to each other by a first hinge and a pair of interior frame members coupled to respective exterior case members by respective second and third hinges. The first, second and third hinges are preferably torsion bar hinges with the first hinge biasing the exterior case members to an open position and the second and third springs biasing the interior frame members toward interior surfaces of the exterior case members. One or both of the exterior case members are preferably provided with a latch structure which allows the folding case to be latched in a closed position. The dimensions of the folding case are preferably such that the case can be carried in a pocket or purse when it is folded into the closed position.

15 Claims, 8 Drawing Sheets

FOLDING PHOTO CASE

BACKGROUND OF THE INVENTION

1. Field of the Invention

The invention relates to photo cases. More particularly, the invention relates to a folding photo case or picture frame incorporating a plurality of springs or other members which hold interior frame members in a closed position.

2. State of the Art

Folding picture frames are well known in the art. Generally, these frames are simply two picture frames coupled to each other by a hinge. By arranging the frames at an angle relative to each other they will stand upright on a flat surface such as a table top.

Folding picture frames are favored for traveling because they fold to seemingly occupy less room than two individual frames and because they can be rapidly displayed in a hotel room, a state room, or other temporary lodging.

Regardless of the convenience of folding picture frames, it is still relatively inconvenient to install a picture in the frame. Folding frames, like most other picture frames, include a removable backing and a piece of glass. In order to install a picture, the backing must be removed. The removal of the backing usually lets loose the glass which presents a hazard. After a picture is installed between the backing and the glass, it is impossible to align the picture in the frame without removing the backing once again.

Despite the general convenience of folding picture frames, they can sometimes be unstable. If the angle between the frames is not sufficiently less than 180°, it is possible for the frames to fall over, possibly breaking the glass in the frames.

SUMMARY OF THE INVENTION

It is therefore an object of the invention to provide a folding photo case or picture frame.

It is also an object of the invention to provide a folding photo case which is easy to load with pictures.

It is another object of the invention to provide a folding photo case which does not contain glass.

It is a further object of the invention to provide a folding photo case which is more stable then state of the art frames.

In accord with these objects which will be discussed in detail below, the folding photo case of the present invention includes a pair of exterior case members coupled to each other by a first hinge and a pair of interior frame members each coupled to a respective exterior case member by respective second and third hinges. According to one aspect of the invention, the first hinge is arranged so that the maximum angle obtained between the exterior case members is sufficiently less than 180° to impart stability to the case when in the open position. According to another aspect of the invention, first, second, and third springs are provided in conjunction with the first, second, and third hinges. The first spring biases the exterior case members to an open position. The second and third springs bias the interior frame members against the exterior case members. One or both of the exterior case members are preferably provided with a latch structure which allows the folding case to be latched in a closed position. Pictures are easily installed in the case by lifting the interior frame members and placing pictures between the interior and exterior members. The second and third springs bias the interior frame members to the exterior case members with pictures captured therebetween. The folding case is preferably made of a precious metal such as gold or silver and the exterior surfaces of the exterior case members are preferably engraved with a decorative design. The dimensions of the folding case are preferably such that the case can be carried in a pocket or purse when the case is folded into the closed position. According to the presently preferred embodiment, each of the springs is a torsion bar spring which is enclosed within a respective hinge as the hinge pin.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
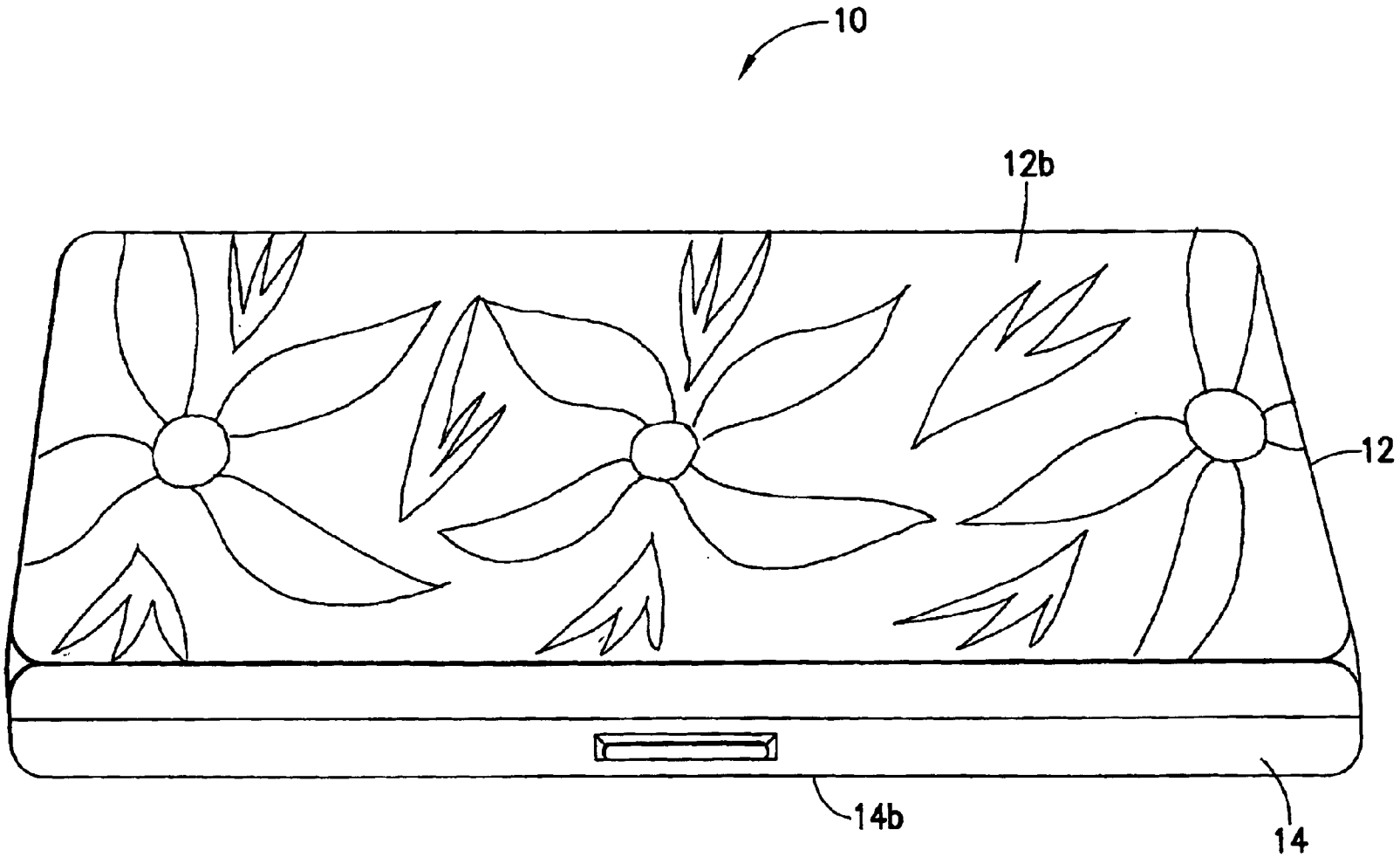
FIG. 1 is a perspective view of a first embodiment of the invention lying flat in the closed position.

Referring now to FIGS. 1 through 4, a first embodiment of a folding photo case 10 according to the present invention includes a pair of exterior case members 12, 14 coupled to each other by a first hinge 16 and a pair of interior frame members 18, 20 each coupled to a respective exterior case member by respective second and third hinges 22, 24. In the first embodiment, interior frame members 18 and 20 are rectangles with four sides, including three frame strips or legs 18*a–c*, 20*a–c*, and fourth rotating tubes 18*d*, 20*d* integral with the legs 18*a–c*, 20*a–c*. The legs and tubes define frame openings for displaying pictures (not shown).

Figure 2:
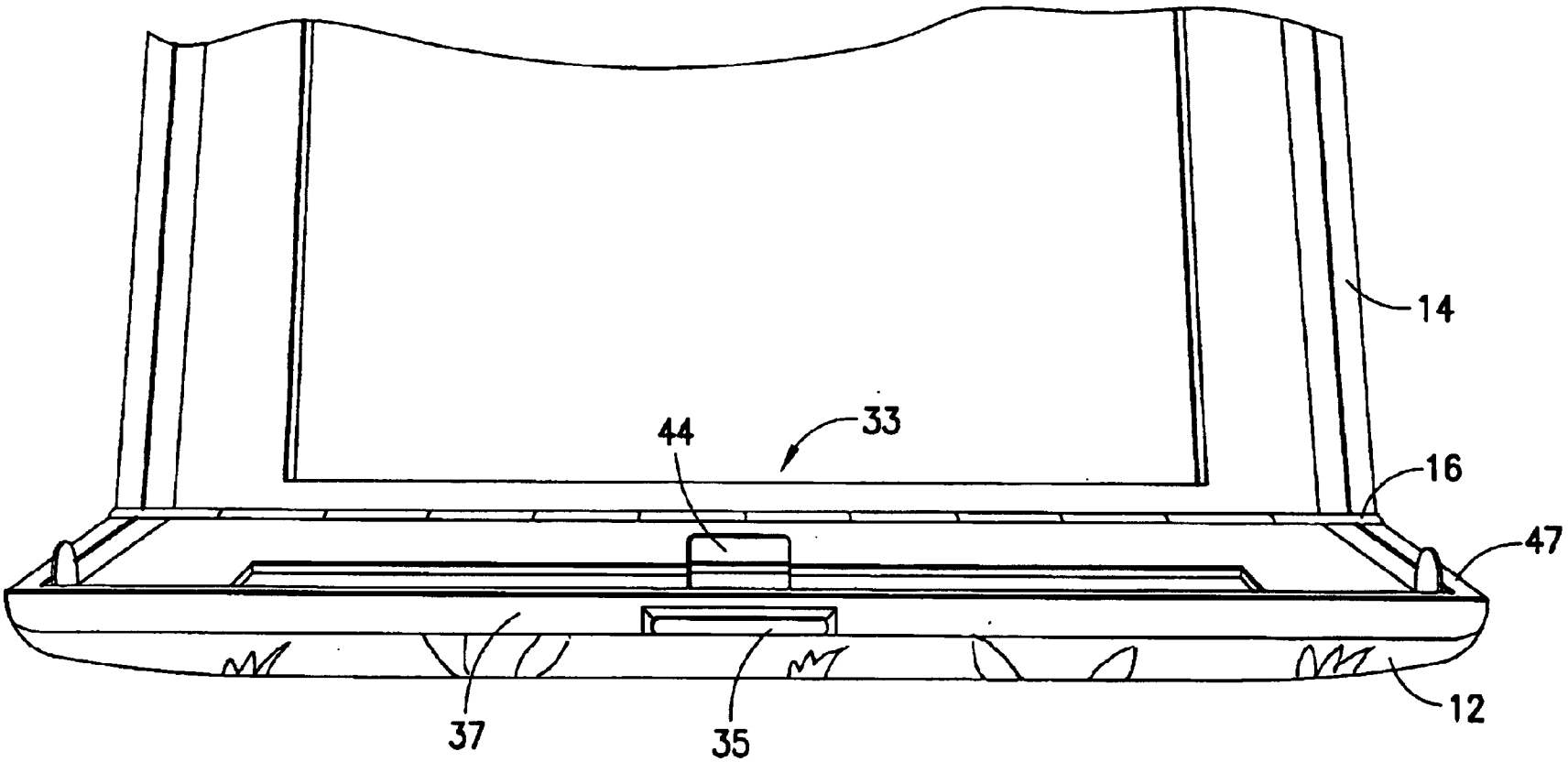
FIG. 2 is a perspective view of the first embodiment lying open and illustrating a clasp member.
Figure 3:
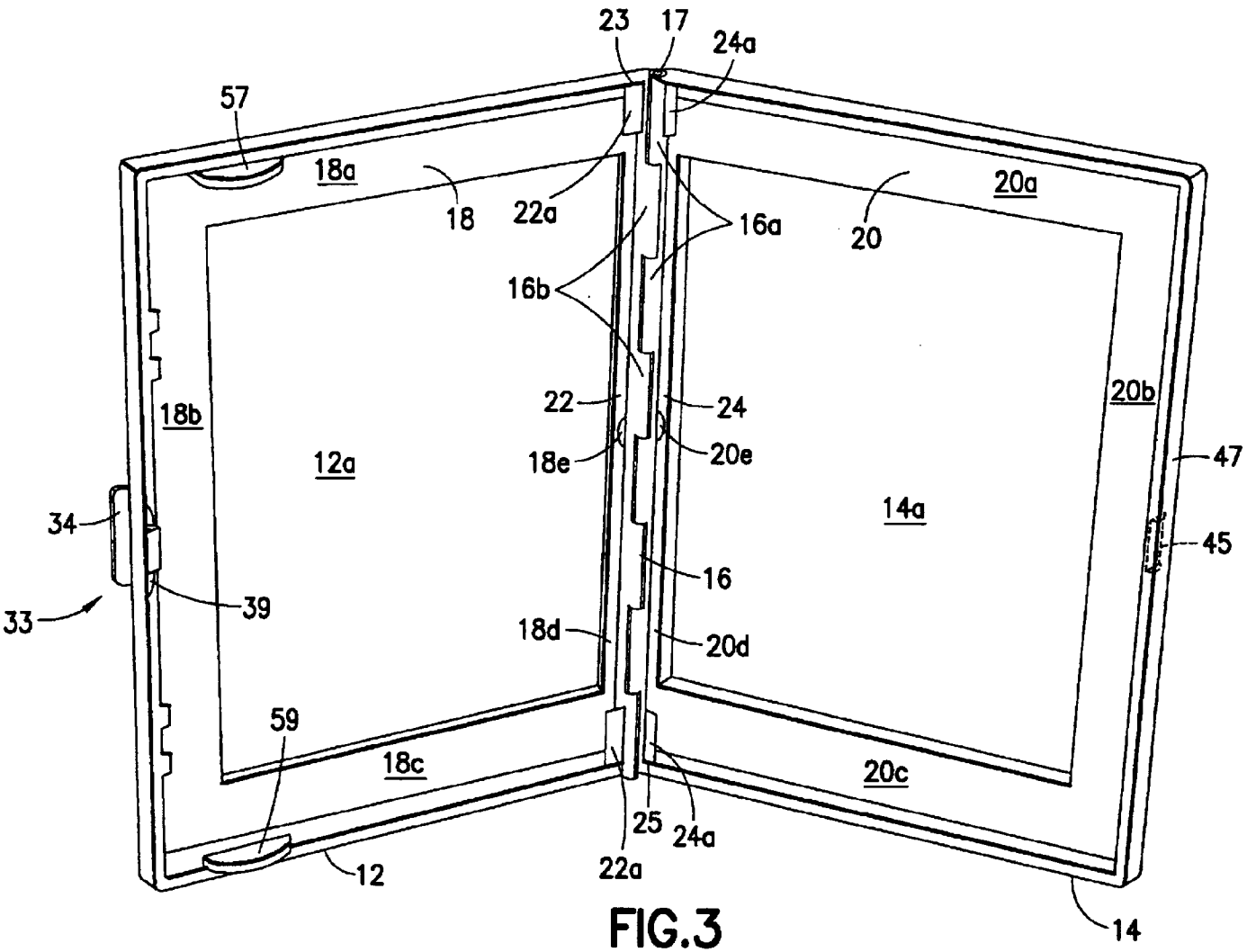
FIG. 3 is a perspective view of the first embodiment standing in an open position.
Figure 4:
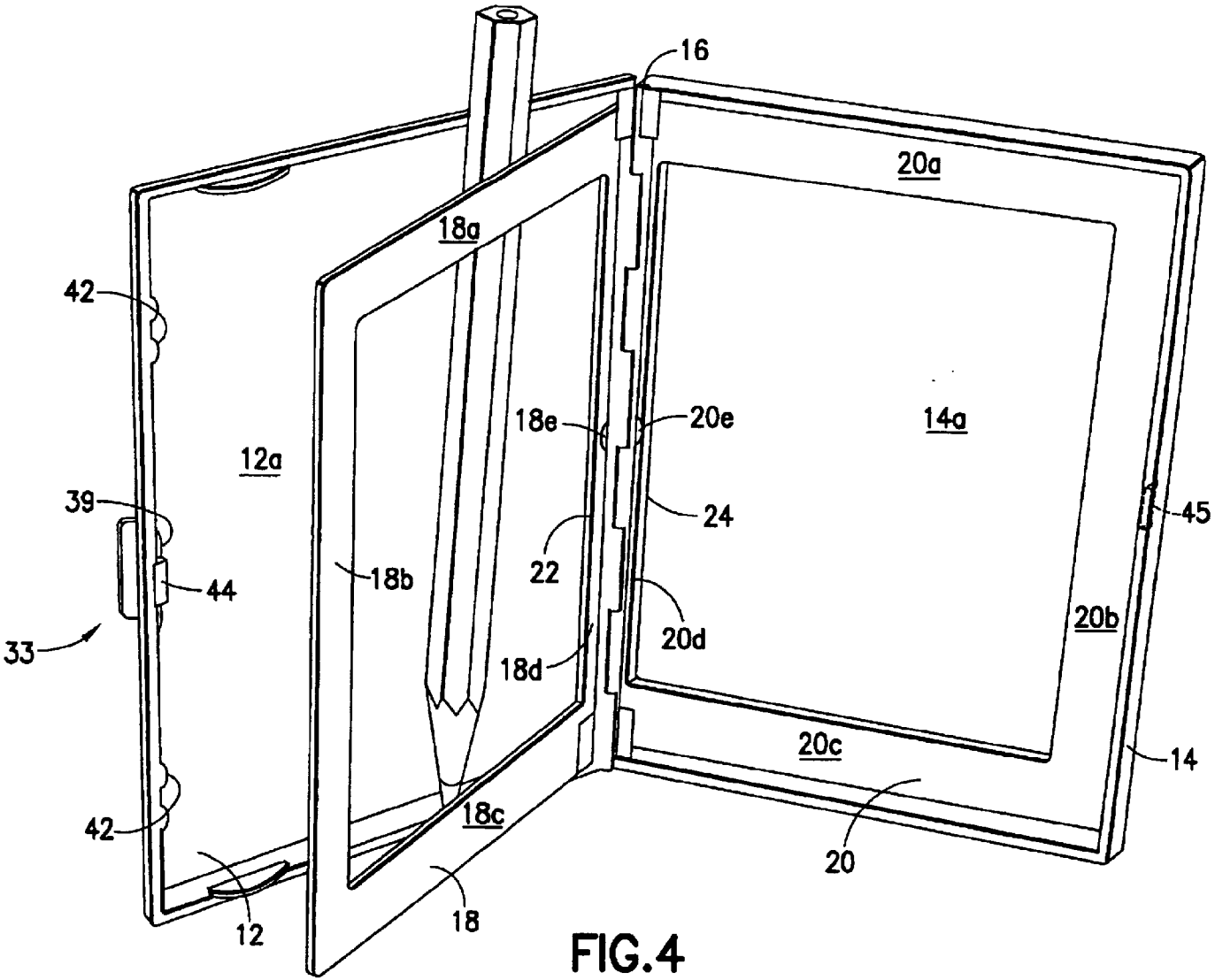
FIG. 4 is a view similar to FIG. 3 illustrating one of the interior frame members lifted up from its respective exterior frame member.

According to one aspect of the invention, the first hinge 16 is arranged so that the maximum angle obtained between the exterior case members 12, 14 is sufficiently less than 180° (e.g., 130°) to impart stability to the case when in the open position as seen in FIGS. 2–4.

According to another aspect of the invention, the first, second, and third hinges 16, 22, 24 are comprised of a plurality of hinge elements and pins 17, 23, 25 which couple those elements. In the case of hinge 16, the hinge elements 16*a*, 16*b* are interleaving hinge elements and an internal pin 17 is provided. In the case of hinges 22, 24, the hinge elements include end elements 22*a*, 24*a*, and the tubes 18*d*, 20*d* of the internal frames, and internal pins 23, 25 are provided.

According to a further aspect of the invention, the pins 17, 23, 25 which couple the elements of the first, second, and third hinges 16, 22, 24 are torsion bars or springs. The first spring or bar 17 is fixed to the hinge elements 16*a*, 16*b* (or to the exterior case members 12, 14, or one of each) and preferably biases the exterior case members 12, 14 to an open position as shown in FIGS. 2–4. The second and third bars 23, 25 are fixed to the hinge elements 22*a*, 24*a*, and to the internal frames (e.g., by crimping the tubes 18*d*, 20*d* at 18*e* and 20*e* to the bars 23, 25), and bias the interior frame members 18, 20 towards respective interior surfaces 12, 14*a* of the exterior case members 12, 14.

As seen best in FIGS. 2–4, the exterior case member 12 is provided with a biased catch 33. The catch 33 includes (i) an L-shaped member 34 which extends through a hole 35 in a peripheral wall 37 of the case member 14, and (ii) a leaf spring 39 which is held in place by brackets 40, 42 which secure the leaf spring to the wall 37. The L-shaped member 34 has a bevel 44 which selectively engages an interior groove 45 defined by a lip 47 which extends from the peripheral wall 37 of the exterior case member 14. The peripheral wall 37 gives the case some internal depth, while the lip 47 presents a flush closing element for the case. The catch allows the folding case 10 to be latched in a closed position shown in FIG. 1. Exterior case member 12 also preferably includes ears 57, 59 which help in alignment of the exterior case members. If desired, the interior frame members 18, may likewise include one or more teeth or ears (not shown) on one or more of their peripheral elements (e.g., on elements 18*b* and 20*b*) to help with alignment of and/or spacing of the inner frame members relative to the outer case members 12, 14 and the lip 47, wall 37, and inner surfaces 12*a*, 14*a* thereof.

As seen best in FIGS. 1 and 2, the first embodiment of the case 10 has outer case members 12, 14 with beveled edges and an engraved design on their outer surfaces.

Referring now to FIG. 4, it can be seen that a picture (not shown) is easily installed in the case by lifting one of the interior frame members 18 and placing the picture between the interior frame member 18 and the interior surface 12*a* of the exterior case member 12. The picture is held in place by the spring 23. Similarly, a second picture can be easily installed by lifting the interior frame member 20.

According to the invention, an interior frame member is established by providing member elements which circumscribe a periphery of approximately 270 degrees or more. Although the interior frame members have been shown as rectangular with rectangular openings to reveal pictures, different shaped openings such as oval, for example, or portions thereof could be used.

The folding case 10 is preferably made of a precious metal such as gold or silver and, as mentioned above, the exterior surfaces 12*b*, 14*b*, of the exterior case members 12, 14 are preferably engraved with a decorative design. The dimensions of the folding case 10 are preferably such that the case can be carried in a pocket or purse when it is folded into the closed position shown in FIG. 1; e.g., 3 in.×4 in.×⅜ in.

As described above, according to the presently preferred embodiment, each of the springs 17, 23, 25 is a torsion bar spring which is enclosed within a respective hinge 16, 22, 24 as a hinge pin. One portion of the torsion bar is coupled to one hinge part and another part of the torsion bar is coupled to the other hinge part such that opening of the hinges twists the torsion bar. It will be appreciated, however, that other types of springs such as leaf springs, for example, could be used.

Figure 5:
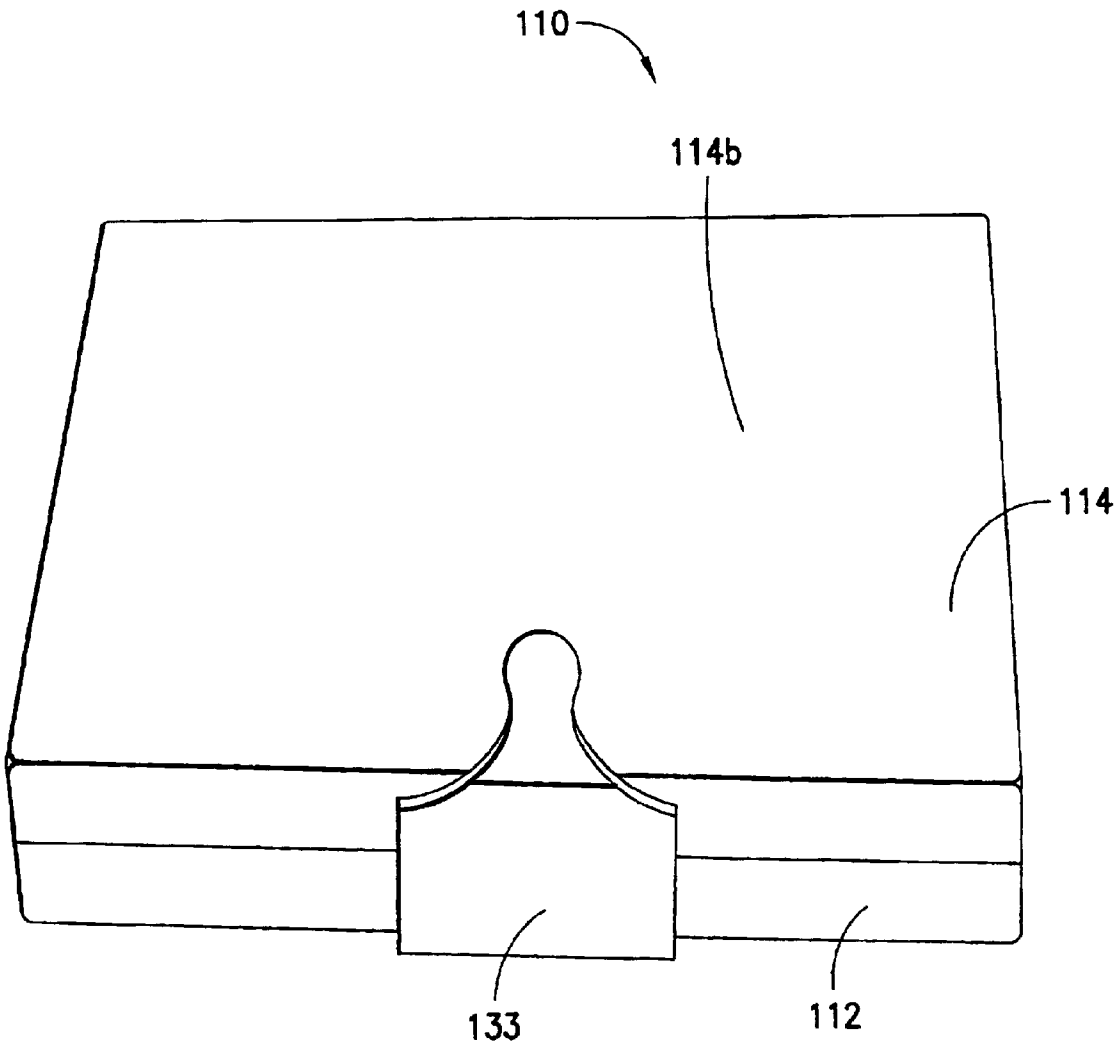
FIG. 5 is a view similar to FIG. 1 illustrating a second embodiment of the invention.
Figure 6:
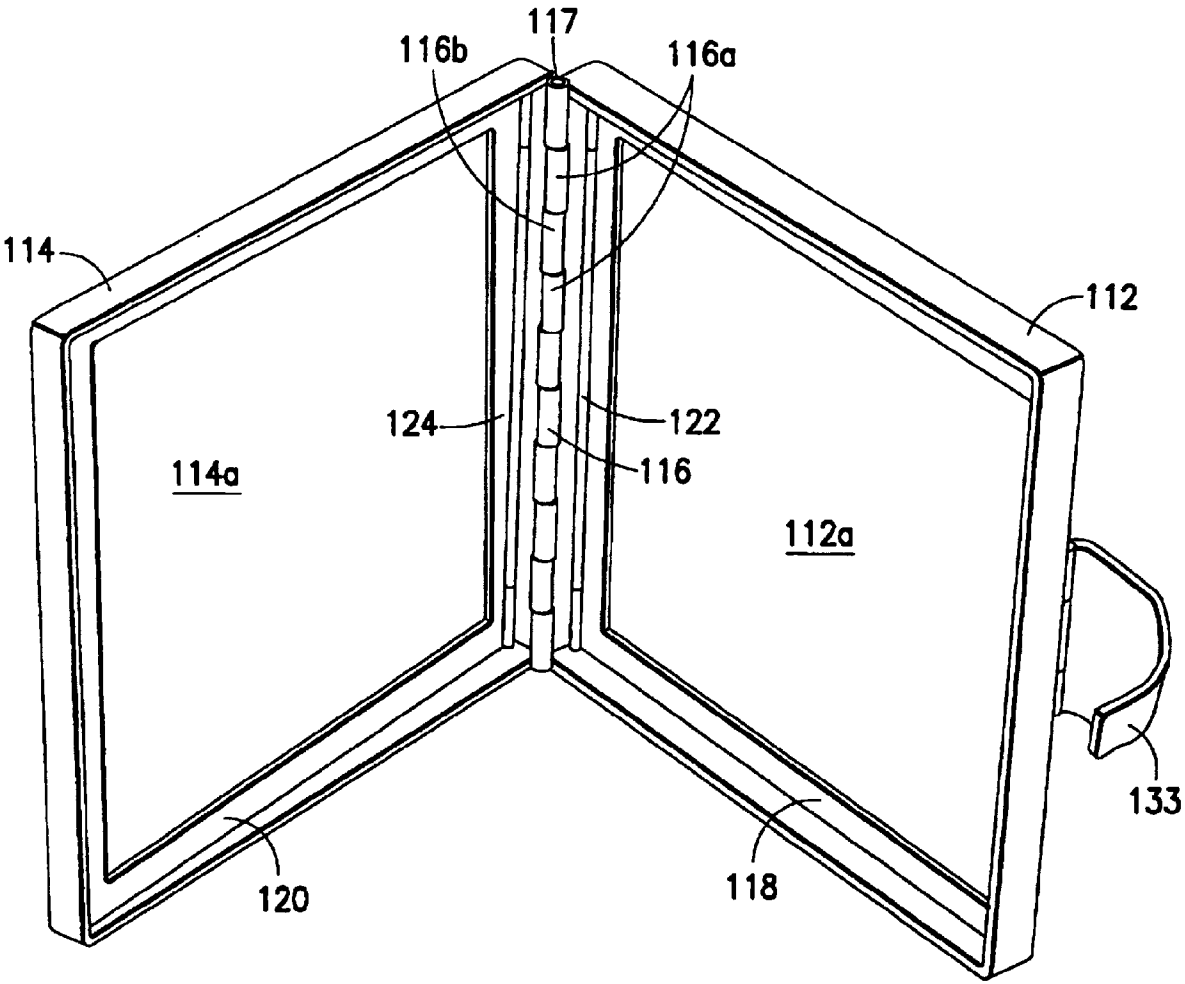
FIGS. 6 and 7 are views similar to FIGS. 3 and 4 illustrating the second embodiment.
Figure 7:
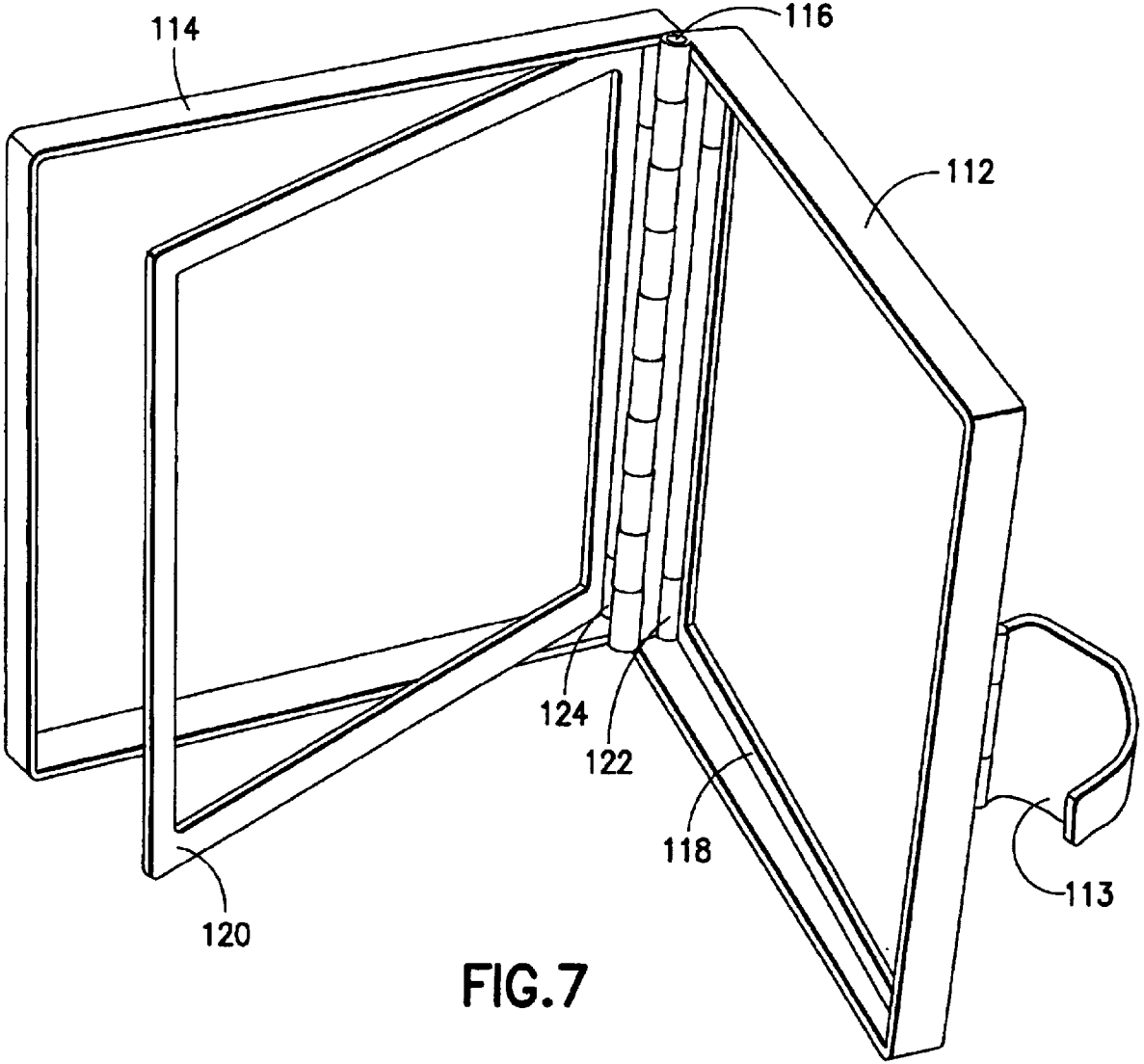

Turning now to FIGS. 5–7, a second embodiment of a case 110 according to the invention is illustrated using similar reference numerals (increased by 100) to refer to similar parts. According to this embodiment, the case is generally square, and exterior case members 112, 114 have rectilinear edges rather than beveled edges. Moreover, the exterior case member 112 is provided with a generally L-shaped clasp 133 which engages the exterior 114*b* of the case member 114 to hold the case in the closed position shown in FIG. 5. In this embodiment, hinge 116 includes interleaved elements 116*a* and 116*b* and pin 117, but pin 117 is not a torsion bar or spring; i.e., the hinge is not spring loaded. On the other hand, frames 118 and 120 each include legs with an innermost leg coupled to a tube 122, 124 having a torsion bar pin extending therethrough. Thus, frames 118 and 120 are each preferably spring-loaded toward the inner surfaces 112*a*, 114*a* of the exterior case members 112, 114.

Figure 8:
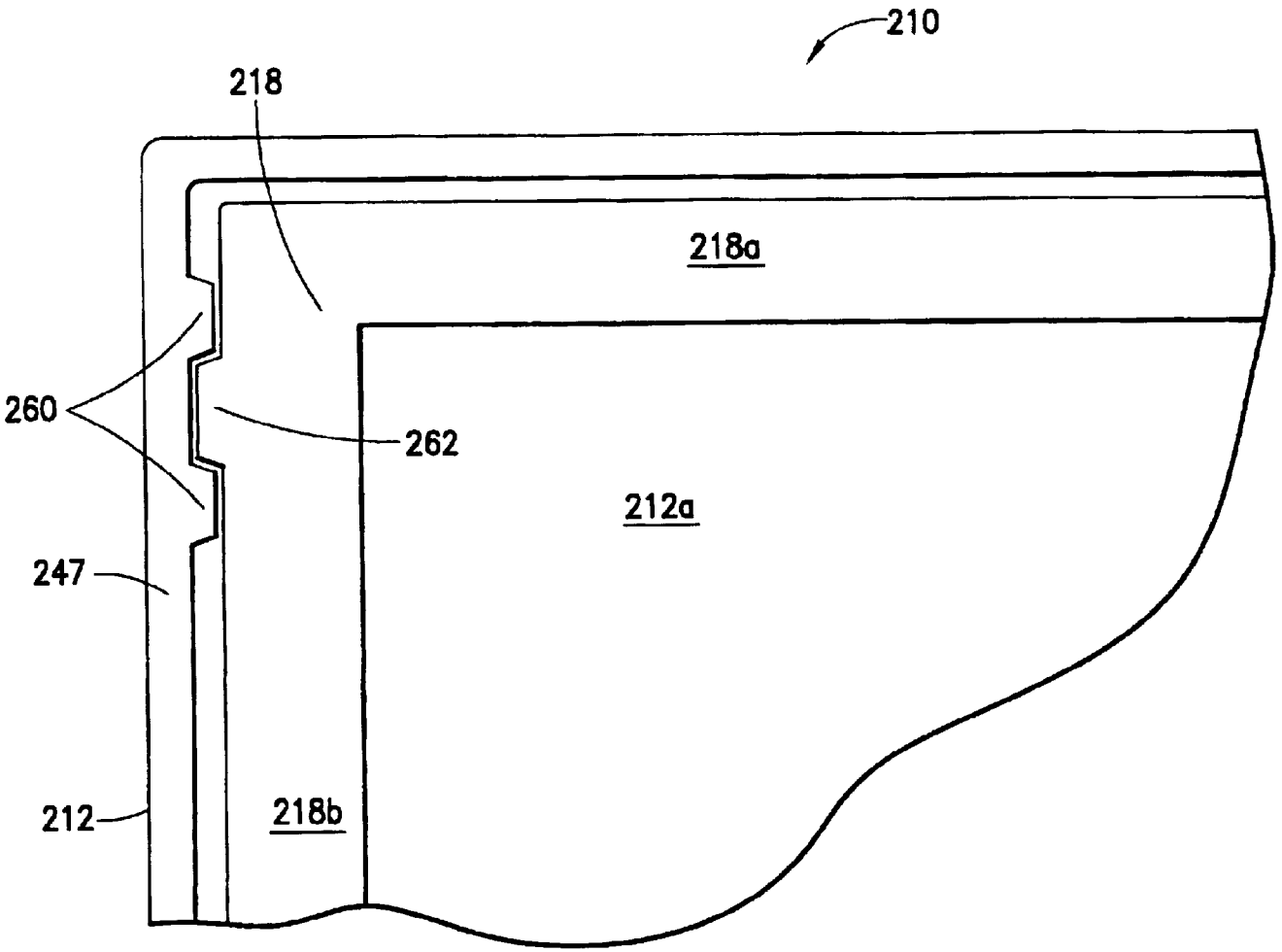
FIG. 8 is a schematic view of a corner of a third embodiment of the invention.

A corner portion of a case 210 according to a third (less preferred) embodiment of the invention is seen in FIG. 8. Case 210 is essentially the same as cases 10 and 110, except that interfering tabs 260, 262 instead of spring members are used to hold the frame(s) elements 218*a*, 218*b* against or adjacent the inner face(s) 212*a* of the exterior case member (s). Multiple sets of interfering tab members for each frame element may be utilized, if desired. As shown in FIG. 8, tabs 260 are integral with the lip 247 of the case member 212, while tab 262 is integral with frame element 218*b* of the inner frame member 218. It will be appreciated, however, that tabs or other interfering members can be utilized on the any of the elements of the frame member 218 and on the lip 247, wall or face 212*a* of the exterior case member 212, in order to hold or lock the interior frame member(s) relative to the exterior case member with a picture (not shown) therebetween. In addition, it will be appreciated that the tabs or interfering elements, rather than being integral with the frame and case members may be attachable to those members and can be made of complaint material. In any event, with the embodiment of case 210, interfering or other catch or coupling members (e.g., Velcro) are utilized to hold the frame member in a closed position after insertion of the picture.

There have been described and illustrated herein several embodiments of a folding photo case. While particular embodiments of the invention have been described, it is not intended that the invention be limited thereto, as it is intended that the invention be as broad in scope as the art will allow and that the specification be read likewise. Thus, while the illustrated embodiments show two exterior case members and two interior frame members, one of the interior frame members could be removed, and if desired, replaced with a mirror, for example, or an engraved message. Also, while the preferred embodiment of the invention is made of precious metal, a folding case according to the invention could be made from non-precious metal or even of plastic or wood. Also, while the invention has been described as having hinges, it will be appreciated that the hinges could be, and preferably are, an integral part of the frame members. Further, while the cases of the invention were described as being of certain size and shape, it will be appreciated that cases of other sizes and shapes could be utilized. In fact, the third embodiment of the invention is particularly useful for oval shaped cases where there is little room to incorporate spring elements. Also, while the cases of the invention were described as having interior frame elements which have hinges located adjacent the hinge of the exterior case members, it will be appreciated that the hinges of the interior frame elements could be located opposite the hinge of the exterior case members or on a side perpendicular the hinge of the exterior case members. It will therefore be appreciated by those skilled in the art that yet other modifications could be made to the provided invention without deviating from its spirit and scope as so claimed.

What is claimed is:

1. A folding photo case, comprising:

a) a first exterior case member having an interior surface;

b) a second exterior case member hingedly coupled to said first exterior case member such that said exterior case members are movable from a closed position to an open position and back;

c) a first interior frame member hingedly coupled to said first exterior case member, said first interior frame member having an opening for displaying a picture, said first interior frame member being substantially coextensive with said interior surface;

d) a first means coupled to said first interior frame member for at least one of coupling and biasing said first interior frame member to or toward said interior surface of said first exterior case members;

e) a spring coupled to said first and second exterior case members and biasing said first and second exterior case members toward the open position;

f) a latch coupled to one of said first and second exterior case members for selectively holding said first and second exterior case members in the closed position;

g) a second interior frame member hingedly coupled to said second exterior case member, said second interior frame member having an opening for displaying a picture; and h) a second means coupled to said second interior frame member for at least one of coupling and biasing said second interior frame member to or toward said second exterior case member.

2. A folding photo case according to claim 1, wherein:

said first means is a spring.

3. A folding photo case according to claim 1, wherein:

the hinged coupling of the first and second exterior case members is arranged to prevent said exterior case members from assuming an angle of as much as 180° between them.

4. A folding photo case according to claim 1, wherein:

said first means is a second spring and said second means is a third spring.

5. A folding photo case according to claim 4, wherein:

at least one of said first means and said second means is a torsion bar.

6. A folding photo case according to claim 5, wherein:

said first spring, said second spring, and said third spring are located adjacent each other.

7. A folding photo case according to claim 1, wherein:

said first means includes a first and second coupling elements, said first coupling element extending from said first interior frame member, and said second coupling element extending from said exterior case member.

8. A folding photo case according to claim 7, wherein:

said first and second coupling elements are interfering tabs.

9. A folding photo case, comprising:

a) a first exterior case member having an interior surface;

b) a second exterior case member hingedly coupled to said first exterior case member such that said exterior case members are movable from a closed position to an open position and back;

c) a first interior frame member hingedly coupled to said first exterior case member, said first interior frame member having an opening for displaying a picture;

d) a first means coupled to said first interior frame member for at least one of coupling and biasing said first interior frame member to or toward said interior surface of said first exterior case member;

e) a second interior frame member hingedly coupled to said second exterior case member, said second interior frame member having an opening for displaying a picture; and f) a second means coupled to said second interior frame member for at least one of coupling and biasing said second interior frame member to or toward said second exterior case member.

10. A folding photo case according to claim 9, wherein:

said second means is a first spring.

11. A folding photo case according to claim 10, wherein:

said first spring is a torsion bar.

12. A folding photo case according to claim 9, wherein:

at least one of said first means and said second means is a torsion bar.

13. A folding photo case, comprising:

a) a first exterior case member having an interior surface;

b) a second exterior case member hingedly coupled to said first exterior case member such that said exterior case members are movable from a closed position to an open position and back;

c) a first interior frame member hingedly coupled to said first exterior case member, said first interior frame member having at least one element which circumscribes a periphery of at least approximately 270 degrees thereby defining an opening for displaying a picture;

d) a first means coupled to said first interior frame member for at least one of coupling and biasing said first interior frame member to or toward said interior surface of said first exterior case member;

e) a second interior frame member hingedly coupled to said second exterior case member, said second interior frame member having an opening for displaying a picture; and f) biasing means coupled to said second interior frame member and biasing it toward an interior surface of said second exterior case member.

14. A folding photo case according to claim 13, wherein:

said first means is a biasing means coupled to said first interior frame member for biasing it toward said interior surface of said first exterior case member.

15. A folding photo case according to claim 14, wherein:

said biasing means comprises a torsion bar fixed at at least one location relative to said first interior frame member and fixed at at least another location to said first exterior case member.

* * * * *